United States Patent [19]

Vartanov et al.

[11] 4,432,584

[45] Feb. 21, 1984

[54] TRENCHING MACHINE FOR CUTTING PREFERABLY FROZEN GROUND

[75] Inventors: Stepan K. Vartanov; Rudolf G. Isupov, both of Leningrad; Vladimir R. Malko, Kharkov; Eino A. Mark, Tallin; Boris I. Kogan, Leningrad; Aref I. Belozerov; Ivan I. Morgachev, both of Moscow; Jury S. Chernik, Leningrad; Konstantin A. Kvitkovsky, Leningrad; Alexei I. Gusev, Leningrad; Nina A. Terentieva, Leningrad, all of U.S.S.R.

[73] Assignee: Leningradskoe Nauchno-Proizvodstvennoe Obiedinenie Zemleroinogo Mashinostroenia, Leningrad, U.S.S.R.

[21] Appl. No.: 297,912

[22] Filed: Aug. 31, 1981

[51] Int. Cl.[3] ..... E21C 25/30; E02F 5/06

[52] U.S. Cl. ..... 299/25; 37/90; 37/191 A; 299/84

[58] Field of Search ..... 299/25, 36, 83, 84, 299/24; 37/191 A, 90

[56] References Cited

U.S. PATENT DOCUMENTS 3,315,384 4/1967 Weyers ..... 37/191 A
4,171,582 10/1979 Morooka ..... 37/90
4,195,427 4/1980 Lanham ..... 37/90
4,217,001 8/1980 Youngers et al. ..... 37/191 A

FOREIGN PATENT DOCUMENTS 304336 6/1971 U.S.S.R. ..... 299/25

OTHER PUBLICATIONS

Machines for Cutting Frozen Ground, Ed. Telulkin, paragraph 2, pp. 148–150.
Const. & Road Bldg. Machines 1978, #5, pp. 4–6.
Highway & Heavy Const., Jul. 1976, p. 62.
Highway and Heavy Const., May 1976, pp. 122–123.
Const. & Road Bldg., 1978, #12, pp. 4–6.

*Primary Examiner*—Ernest R. Purser
*Attorney, Agent, or Firm*—Murray Schaffer

[57] ABSTRACT

Disclosed is a trenching machine comprising a vehicle of a tractor type, a drive mechanism, a spoil discharge conveyor assembly, and a digging apparatus including a boom connected with its one end to the vehicle, a power means for raising and lowering the boom, a guide means mounted on the boom, a carrying means moving along the guide means, teeth mounted on the carrying means along alternate first cutting lines and second cutting lines in the direction of movement of the carrying means, the number of the teeth mounted along the first cutting lines being greater than that of the teeth mounted along the first cutting lines across the width of the carrying means being greater than the width of the teeth mounted along the secod cutting lines.

4 Claims, 5 Drawing Figures

TRENCHING MACHINE FOR CUTTING PREFERABLY FROZEN GROUND

FIELD OF THE INVENTION

The present invention relates to continuous digging machines, and more particularly to trenching machines for cutting preferably frozen ground.

The present invention can be used most advantageously in the constructions of ladder trenchers specially designed for cutting trenches in frozen ground, in which crawler tractors are used as a vehicle.

The trenching machine according to the present invention can be also efficiently employed for cutting trenches in non-frozen particularly firm ground which cannot be directly trenched by other digging machines.

Besides, in combination with power shovels, scarifiers and bulldozers, the trenching machine according to the present invention can be used to dig pits and trenches of a width greater than that of an implement.

BACKGROUND OF THE INVENTION

Frozen ground and particularly permafrost as well as hard rock which can be trenched by mechanical cutting possess very high resistance to digging and exhibit abrasive properties. In trenching, the natural properties of such materials are the cause of appreciable power consumption and high maintenance costs.

Besides, the resistance of frozen ground to digging, varying with trench depth, results in a high dynamic loading during the process of trenching and an attendant low reliability for continuous trenching machines.

Local irregularities on the surface of frozen ground cannot be levelled, and therefore the construction of a trenching machine should provide a means so that its travel and operation along such routes is enabled.

The requirements to reduce power consumption and maintenance costs, to improve the reliability of trenching machines, to provide for their operation on a rough ground, as well as other requirements made it necessary to develop trenching machines whose construction and operation are based upon a variety of principles.

In the general practice of cutting slits and trenches in frozen ground extensive use has been made of the designs peculiar to cutters of coal-cutting and coal-mining machines. Thus, for example, there known in the prior art a ladder trenching machine ЭТЦ -161 with a replaceable trenching part for cutting frozen ground, taken from a coal-cutting machine (Cf. "Mashiny dlya razrabotki merzlykh gruntov" /Machines for Cutting Frozen Ground/ edited by V. D. Telushkin, Mashinostroenie Publishing Company, Moscow, 1973, pp. 146–150), a three-jib trenching machine for cutting frozen ground (Cf. Stroietelnye i dorozhnye mashiny, 1978, No. 5, Mashinostroenie Publishing Company, pp. 4–6), and Roc Saw ladder trenching machine developed by Boring and Tunneling Company of America, Houston, Tex. (Cf. Highway and Heavy Construction, July 1976, p. 62, and May 1978, pp. 122–123).

These trenching machines comprise a vehicle of a tractor type, a digging apparatus, a spoil discharge conveyor assembly, and a drive mechanism. The digging apparatus comprises a boom and a support and guide slide means with an endless cutting chain around it. The cutting chain consists of pivotally interconnected links having therein holes to receive teeth which are arranged in a fanshaped pattern (a so-called "herringbone" arrangement). A belt conveyor can be used as the spoil discharge conveyor assembly in the trenching machines of said type.

The trenching machines with such a digging apparatus are sufficiently efficient when cutting only narrow trenches (slits) in frozen ground and rock. As a result, when cutting trenches for pipelines and other line structures, the trenching machines with such a digging apparatus only prepare a front for other machines, primarily power shovels, cutting along the trench contour longitudinal and, if required, transverse slits. The use of cutters of coal-cutting machines for direct digging of trenches of a required section in frozen ground and rock is much less efficient since the teeth mounted on such cutters in a fan-shaped arrangement fill up the entire trench section and pulverize these highly firm and abrasive materials to a great extent. This results in a high specific power consumption and a substantial consumption of the teeth with expensive carbide tips. When it is required to cut wide trenches, a digging apparatus, as a rule, is completed with an appropriate number of such cutting chains mounted in parallel. Such a design not only complicates the construction of the digging apparatus and raises its cost, but still further increases specific power consumption and the consumption of the teeth.

The endless cutting chain in this construction of the trenching machine moves along the entire length of the support and guide slide means. Such a design provides a reliable support and guiding of the cutting chain, but requires a high power consumption to overcome sliding friction and causes a rapid wear of the support and guide means and of the cutting chain itself.

The use of a belt conveyor as the spoil discharge conveyor assembly requires that the distance between the vehicle and the digging apparatus should be enlarged to accomodate this rather wide conveyor. The belt conveyor is mounted at such a height which provides free travel over irregularities of the ground surface. Besides, combination of this digging apparatus with the belt conveyor causes the increase of the required height of spoil discharge. Thus, the use of the belt conveyor results in the increase of the mass and size of the trenching machine.

Also known in the art is a ladder trenching machine Type ЭТЦ -208A specially designed to cut frozen ground (Cf. an article "Exkavator transheyny tsepnoy ЭТЦ -208A / ЭТЦ -208A Ladder Trenching Machine/ by S. Kh. Vartanov et al. published in the section "Digging Machines" of a journal "Stroitelnye i dorozhnye mashiny", 1978, No. 12, pp. 4–6), which is the nearest in its principle to the proposed invention and chosen as the prototype.

Said trenching machine comprises a vehicle of a tractor type, a digging apparatus, a spoil discharge conveyor assembly, and a drive mechanism. The digging apparatus comprises a boom connected with the vehicle, a support and guide rolling means mounted on the boom, and an endless draft chain around said means, said chain being made as a tractor caterpillar whereto carrying members with teeth and wedges are attached by threaded fastening elements. The teeth and wedges are mounted along longitudinal lines, and the teeth are higher than the wedges. The teeth loosen successively and continuously frozen ground mass by cuttings, and ground blocks left therebetween are periodically spalled due to a side thrust of the wedges. The support and guide means comprise a wheel mounted at the free end of the boom, a plurality of rollers arranged along said boom, and a take up means. The spool discharge conveyor assembly is made as a flight conveyor comprising a frame with arms mounted thereon and carrying drive and idler wheels, and an endless chain with flights which rounds these wheels. One of the arms on a side leg of the frame is pivoted to the frame and connected with a hydraulic cylinder to shift the side portion of the flight chain into travelling position. The drive mechanism comprises a drive sprocket wheel disposed on the longitudinal axis of the digging apparatus and coupled through a transmission to the engine of the vehicle, and safety means.

The foregoing trenching machine is much more efficient when cutting trenches in frozen ground as compared to the trenching machines with a cutter similar to that of coal-cutting machines since it provides for the digging of a trench of a required section in one cut.

However, this trenching machine is insufficiently versatile in its application in frozen grounds of various structures, and its efficiency and serviceability do not fully meet arduous operating conditions.

The wedges of such a digging apparatus are rather efficient when spalling the blocks of hard-frozen ground exhibiting pronounced brittle properties. However, in initial entry and further cutting into frozen ground with predominant plastic properties the wedges do not spall the blocks of frozen ground due to their side thrust, but squash them, which reduces the output and does not provide versatile application of the trenching machine in frozen grounds of various structures. Besides, periodic action of the wedges results in an increased dynamics of the process and affects the reliability of the digging apparatus and of the entire trenching machine. Mounting of the teeth and wedges which are different in their construction on the same digging apparatus additionally complicates its fabrication and maintenance. The digging apparatus is also characterized in that the total number of the teeth and wedges mounted thereon still remains rather great.

Making the digging apparatus with an endless chain of a caterpillar type most fully meet the requirements of fabrication and conditions of operation of the digging apparatus of the trenching machines for cutting frozen ground. Such a chain is of sufficiently high strength and wear resistance. Besides, such chains are widely used in industry and their cost is rather low. However, connection of the members carrying the teeth with the chain of a caterpillar type by threaded fastening elements exhibits strength considerably lower than the breaking strength of the chain. This feature makes it impossible to employ to a full degree the strength properties of the endless chain of a caterpillar type. What is more, in the course of operation of this trenching machine ground pressing-on and freezing-on as well as jamming of stones between the chain links and the drive sprocket wheel of the drive mechanism occur which not only affects the efficiency of the trenching machine, but also may result in its failure. Takeup and safety means incorporated into the digging apparatus cannot prevent such failures. Another constructional feature of this trenching machine consists in the fact that the distance between the axis of the wheel mounted at the lower end of the boom and the axis of the nearest roller cannot be less than the pitch of the draft chain. Hence, with initial entry of the digging apparatus into frozen ground and when cutting trenches of a small depth, the draft chain is turned, the cutting angle of the teeth is consequently enlarged, and the dynamics of the process is increased.

The trenching machine of this construction is also characterized in that the position of the lower portion of the flight conveyor is not adjustable for height, which affects the performance of the trenching machine and the reliability of the conveyor when travelling and operating over rough ground.

SUMMARY OF THE INVENTION

It is an object of the present invention to provide a trenching machine for cutting preferably frozen ground which is efficient and reliable in operation.

Another object of the present invention is to provide a highly efficient cutting of frozen ground by the trenching machine with reduced dynamic loads and with rather low energy consumption.

A further object of the present invention is to provide compactness and transportability of the trenching machine.

A further object of the present invention is to provide a high strength of a digging apparatus of the trenching machine and its high operating reliability with low maintenance costs.

A further object of the present invention is to reduce the number of teeth of the digging apparatus of the trenching machine with expensive carbide tips.

A further object of the present invention is to provide a substantial increase of the width of a trench being cut with high reliability of the digging apparatus of the trenching machine.

A further object of the present invention is to provide a high reliability of the digging apparatus of the trenching machine and an increase of its efficiency when operating at small depths and when the digging apparatus works into ground on initial stages of digging.

A further object of the present invention is to provide reliable operation of a spoil discharge conveyor assembly of the trenching machine as it moves over rough surface of frozen ground.

With these and other objects in view there is provided a trenching machine for cutting preferably frozen ground, comprising a vehicle of a tractor type, a digging apparatus, a spoil discharge conveyor assembly, a drive mechanism, wherein according to the invention said digging apparatus includes a boom connected with its one end to said vehicle, a power means for raising and lowering said boom, a support and guide means mounted on said boom, a carrying means moving along said guide means, teeth mounted on said carrying means along alternate first cutting lines and second cutting lines in the direction of movement of said carrying means, the number of said teeth mounted along said first cutting lines being greater than that of said teeth mounted along said second cutting lines and the distance between said teeth mounted along said first cutting lines across the width of said carrying means being greater than the width of said teeth mounted along said second cutting lines.

Such an embodiment of the trenching machine provides preliminary and continuous loosening of the mass of frozen ground with cuttings formed with rather a little advance by the teeth mounted along said first cutting lines, and ground blocks left between said cuttings are crushed by the teeth mounted along said second cutting lines with a multiple increase of feed and under unlocked conditions. It is just this fact as well as brittleness of frozen ground make it possible to dig across the entire section of a trench by the teeth mounted along said first and second cutting lines though a total width of these teeth is less than the trench width, which provides a decrease of energy consumption required by the process of digging and an increase of the output of the trenching machine as well as a reduced dynamics of the operating process, an improved reliability of the trenching machine, and a possibility to reduce a total number of the teeth on the digging apparatus.

According to one of the embodiments of the invention said carrying means comprises a plurality of carrying members each of which has at least one apertured leg fixed thereon and which are mounted on an endless draft chain of a caterpillar type including links and bushings with pins extending through these bushings and said apertures of said legs and having rollers mounted on its ends projecting beyond said chain links and interacting with sprocket wheels of said drive mechanism.

Such an embodiment of the carrying means provides a secure attachment of the carrying members to the draft chain, which makes it possible to make the most use of its breaking strength and eliminates power losses and failures because of pressing-on and freezing-on of ground and jamming of stones between the links of the draft chain and the sprocket wheels of the drive mechanism. Besides, such an embodiment of the carrying means additionally stiffens the carrying members and due to this makes it possible to enlarge the width of the digging apparatus to dig wider trenches without an increase of the width of the draft chain.

According to another embodiment of the invention it is advisable to make a trenching machine in which said carrying means comprises a plurality of carrying members mounted on the endless draft chain, and said support and guide means comprises a wheel mounted at the free end of said boom, a plurality of rollers disposed along said boom, and a thrust shoe mounted on the lower side of said boom between said wheel and said roller nearest thereto.

Such an embodiment of the trenching machine eliminates turning of the links of the draft chain at the section between the wheel and the roller nearest thereto and thus prevents additional loads from being transmitted to the draft chain and to the entire digging apparatus. This improves serviceability of the digging apparatus of the trenching machine and makes it possible to work it into frozen ground and to cut trenches of a small depth with a great efficiency.

According to still another embodiment of the invention it is advisable to make a trenching machine in which said spoil discharge conveyor means comprises a frame mounted on said vehicle, arms with at least one drive wheel and idler wheels, mounted on said frame and interconnected by a linkage, said arms mounted on the lower side of said frame and at least one of the outer arms being pivotally supported on said frame, an endless flight conveyor means going around said wheels, and a hydraulic cylinder operating the linkage, mounted on one of the side legs of said frame and connected with one of the arms pivotally supported on the lower side of the frame.

Such an embodiment of the trenching machine makes it possible to vary the height of the position of the lower portion of the spoil discharge conveyor assembly in the course of digging to go over obstacles and irregularities on the surface of frozen ground. Besides, when the spoil discharge conveyor assembly is brought into its upper travelling position, its width is simultaneously reduced, which is additionally beneficial for compactness and transportability of the trenching machine.

These and other objects and advantages of the present invention will become more apparent upon consideration of the following detailed description of its embodiments taken with reference to the accompanying drawings.

BRIEF DESCRIPTION OF THE ACCOMPANYING DRAWINGS

DETAILED DESCRIPTION OF THE INVENTION

Figure 1:
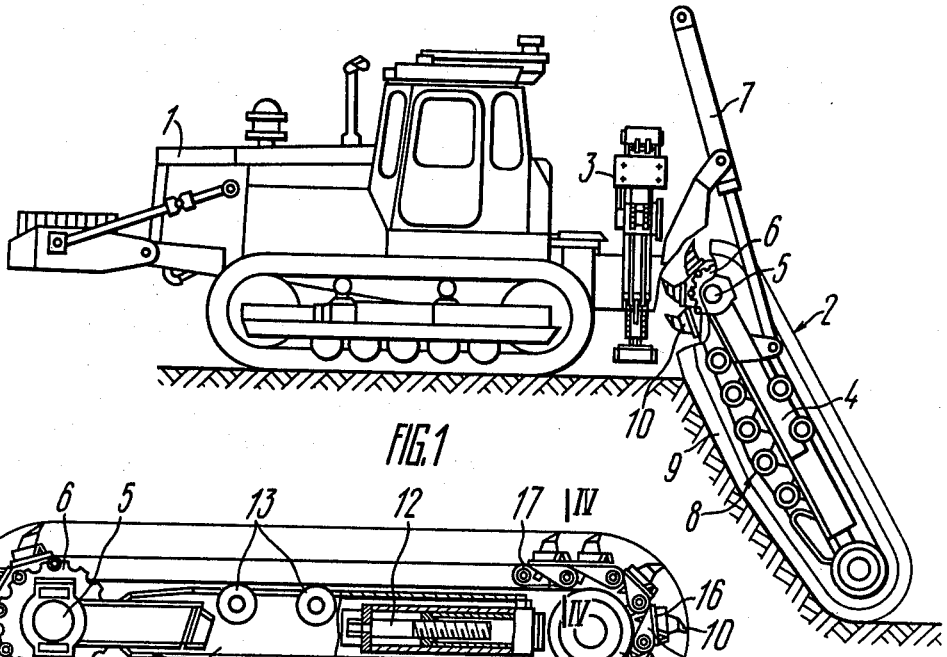
FIG. 1 is a general view of a trenching machine for cutting primarily frozen ground, according to the invention.

A trenching machine for cutting primarily frozen ground comprises a vehicle 1 (FIG. 1) of a tractor type whose transmission (not shown in the drawings) should make it possible to reduce and adjust the speed within a required range in the course of operation or should be complete with an auxilliary mechanism (not shown in the drawings) to accomplish this, a digging apparatus 2, a spoil discharge conveyor assembly 3, and a drive mechanism (not shown in the drawings) driving the digging apparatus 2 and spoil discharge conveyor assembly 3.

Figure 2:
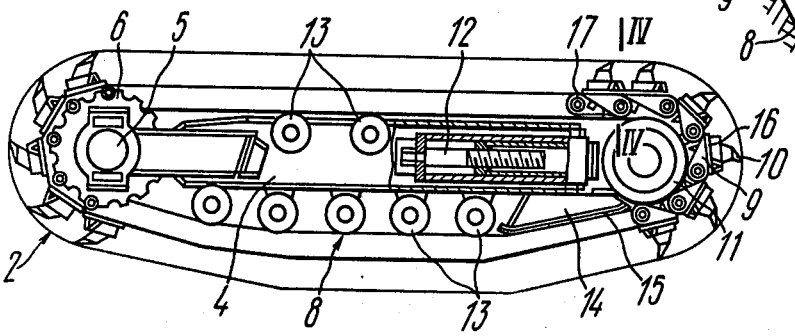
FIG. 2 is an enlarged general view of a digging apparatus shown in FIG. 1, according to the invention.
Figure 3:
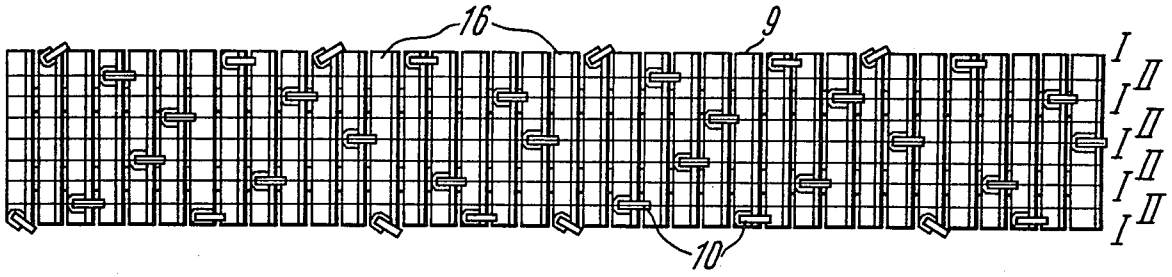
FIG. 3 is an enlarged view of a carrying means with teeth mounted thereon, shown in FIG. 1 and given in a developed form, according to the invention.

The digging apparatus 2 comprises a boom 4 pivotally supported on the vehicle 1 around the axis of a drive shaft 5 with two sprocket wheels 6 mounted thereon and coupled with the drive mechanism, a power means 7 for raising and lowering the boom 4, a support and guide means 8 mounted on the boom 4, a carrying means 9 going around the sprocket wheels 6 and support and guide means 8, and teeth 10 (FIGS. 1, 2, 3) mounted on the carrying means 9.

The support and guide means 8 (FIG. 2) comprises a wheel 11 mounted at the free end of the boom 4 and connected with an adjusting means 12 mounted on the boom 4, a plurality of rollers 13 disposed along the boom 4, and a thrust shoe 14 which is disposed on the lower side of the boom 4 between the wheel 11 and the roller 13 nearest thereto. At least a portion of a bearing surface 15 of the thrust shoe 14 goes along a tangent to the wheel 11 and to the nearest roller 13.

The carrying means 9 (FIGS. 2 and 3) comprises a plurality of carrying members 16 whereon the teeth 10 are fixed along alternate first and second cutting lines I and II (FIG. 3), the number of the teeth 10 mounted along the first cutting lines I being greater than that of the teeth 10 mounted along the second cutting lines II. The distance between the teeth 10 mounted along the first cutting lines I across the width of the carrying means 9 is greater than the width of the teeth 10 mounted along the second cutting lines II.

The carrying members 16 are mounted on an endless draft chain 17 (FIG. 2) of a caterpillar type comprising links 18 (FIG. 4), bushings 19 pressed into the links 18, and pins 20. Each carrying member 16 has apertured legs 21 fixed thereto. The pin 20 loosely extends through the apertured legs 21 and bushing 19 and is pressed into the links 18, the ends of the pin 20 projecting beyond the links 18. These ends of the pin 20 have rollers 22 loosely mounted thereon and interacting with the sprocket wheel 6 (FIG. 1) coupled to the drive mechanism. The rollers 22 (FIG. 4) are secured on the ends of the pin 20 by securing means 23. The carrying members 16 are additionally fixed to the links 18 in a conventional way by threaded fastening elements (not shown in the drawing). When it is required to cut narrow trenches, only one apertured leg is fixed to the carrying member 16.

Figure 5:
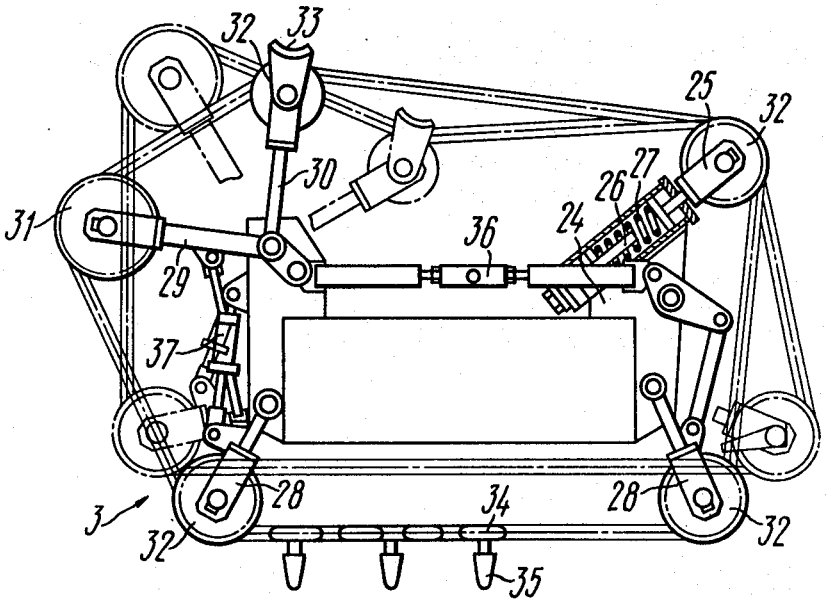
FIG. 5 is an enlarged view of a spoil discharge conveyor assembly shown in FIG. 1 as viewed from the digging apparatus, according to the invention.

FIG. 5 shows the spoil discharge conveyor assembly 3 comprising a frame 24 mounted on the vehicle 1 (FIG. 1), an arm 25 (FIG. 5) rigidly fixed to the frame 24 and comprising an adjusting means 26 with a takeup means 27, arms 28 pivotally supported on the lower side of the frame 24, and arms 29 and 30 also pivotally supported on the frame 24. The arm 29 has a drive wheel 31 mounted thereon and coupled with the drive mechanism. The other arms 25, 28 and 30 are complete with idler wheels 32. The arm 30 has a shackle 33 pivotally mounted thereon. The drive wheel 31 and the idler wheels 32 are rounded by an endless flight conveyor means 34 which in this embodiment is represented by a chain with flights 35. The arms 28, 29 and 30 are interconnected by a linkage 36. The frame 24 has a hydraulic cylinder 37 mounted on its side leg which operates the linkage 37 and is connected with one of the arms 28.

The trenching machine for cutting primarily frozen ground operates as follows.

The drive mechanism (not shown in the drawings) of the digging apparatus 2 (FIG. 1) and spoil discharge conveyor assembly 3, driven by the engine of the vehicle 1, is engaged. By means of the power means 7 the boom 4 of the digging apparatus 2 is turned around the axis of the shaft 5 and worked into ground, the carrying means 9 bearing up with the links 18 (FIG. 4) against the wheel 11 (FIG. 2) and adjacent thrust shoe 14, which prevents the endless draft chain 17 from turning in its pivots, provides an accelerated process of entering of the digging apparatus 2 into ground, and makes for efficient cutting of trenches including small-depth ones. After the digging apparatus 2 is worked in to a required depth, the trenching machine starts trench cutting.

Figure 4:
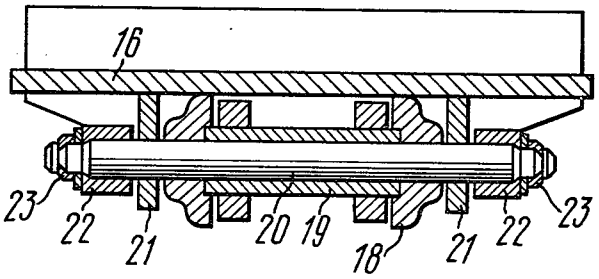
FIG. 4 is a sectional view taken along the line IV—IV of FIG. 2.

In the course of initial entry and further trenching the teeth 10 mounted along the first cutting lines I (FIG. 3) work in the ground parallel cuttings, and the teeth 10 mounted along the second cutting lines II crush ground blocks left between the cuttings under unlocked conditions and with a greater feed. The ground thus worked is lifted from the trench by the carrying members 16 and teeth 10, stones and lumps of frozen ground being unable to stay on the cylindric surface of the rollers 22 (FIG. 4) and to seize up the carrying means 9 (FIG. 2) as it interacts with the sprocket wheels 6 by means of the rollers 22 (FIG. 4). As the rollers 22 interact with the sprocket wheels 6 (FIG. 2) they are self-cleaned, and therefore pressing and freezing of ground on these rollers 22 (FIG. 4) are also eliminated. Abrasive particles of frozen ground cannot get between the bushings 19, links 18 and pins 20 since these parts are assembled with an interference fit. Digging loads exerted on the teeth 10 (FIG. 2) are taken by the strong pins 20 (FIG. 4), which ensures reliable connection of the carrying members 16 with the endless draft chain 17 (FIG. 2) of a caterpillar type for the entire service life of the carrying members 16. The apertured legs 21 (FIG. 4) provide a reduction of the length of overhanging portions of the carrying members 16, which makes it possible to enlarge the width of the carrying members 16 and, hence, the width of a trench being cut using the same draft chain 17 (FIG. 2) and boom 4.

As soon as the spoil is elevated from a trench by the digging apparatus 2, it is picked up by the flights 35 (FIG. 5) and transported by the endless flight conveyor means 34 to a dump.

According to a cutting depth the distance to the dump formed by the spoil discharge conveyor assembly 3 is adjusted by varying the speed of movement of the endless flight conveyor means 34. If the flights 35 meet with not very high elevations on the surface of frozen ground, the endless flight conveyor means 34 goes over these obstacles without stopping its movement due to deformation of the takeup means 27. When coming up against higher obstacles, the endless flight conveyor means 34 is promptly raised by means of the hydraulic cylinder 37 and linkage 36 and having passed over the obstacles, the endless flight conveyor means 34 is lowered into its original position. The tension of the endless flight conveyor means 34 in such manoeuvres remains constant due to appropiate dimensions of the component parts of the spoil discharge conveyor assembly 3 and due to the takeup means 27 and shackle 33. Therefore movement and operation of the endless flight conveyor means 34 are possible at any height of its position and with reversing of the direction of movement.

When the work is finished, the digging apparatus 2 (FIG. 1) and the spoil discharge conveyor means 3 are raised into travelling position, whereby a road clearance is enlarged and the width clearance of the spoil discharge conveyor assembly 3 is simultaneously reduced.

When required, this trenching machine may be employed in combination with other digging machines to dig pits and wide trenches in frozen ground. In so doing, the trenching machine cuts parallel longitudinal trenches, simultaneously filling up the previous trench by means of the spoil discharge conveyor means 3, whereupon loosened ground and intervening walls are efficiently removed by other digging machines. In such works this compact and mobile trenching machine may successfully compete with more powerful, but large-sized and costly continuous trenching machines and scarifiers.

From the specific embodiments of the present invention it is readily apparent to those skilled in the art that all the objects of the invention can be accomplished within the scope of the appended claims. The aforementioned embodiments of the invention do not limit the scope of the latter and are given merely as an illustration. It is also readily apparent that insignificant changes in the construction of the trenching machine can be made without departing from the spirit of the invention. Specifically, said digging apparatus may be made as a rotor with teeth mounted thereon along first and second cutting lines as mentioned above, and it is possible to use in this case buckets mounted on a rotor-type digging apparatus as the carrying members. Besides, the caterpillars of the vehicle may comprise a draft chain similar to that of the carrying means of the aforementioned digging apparatus.

All these and other changes are considered to be within the spirit and scope of the invention as defined in the claims below.

What is claimed is:

1. A trenching machine for cutting preferably frozen ground, comprising:

a vehicle of a tractor type;

a digging apparatus;

a spoil discharge conveyor assembly;

a drive mechanism;

said digging apparatus including:

a boom connected with its one end to said vehicle;

a power means for raising and lowering said boom;

a support and guide means mounted on said boom;

a carrying means moving along said support and guide means;

teeth mounted on said carrying means along each of at least two alternate first cutting lines and second cutting lines in the direction of movement of said carrying means, the number of said teeth mounted along said first cutting lines being greater than that of said teeth mounted along said second cutting lines, and the distance between said teeth mounted along said first cutting lines across the width of said carrying means being greater than the width of said teeth mounted along said second cutting lines.

2. A trenching machine according to claim 1, wherein said carrying means comprises a plurality of carrying members each of which has at least one apertured leg fixed thereon and which are mounted on an endless draft chain of a caterpillar type including links and bushings with pins extending through said bushings and apertures of said legs and having rollers mounted on its ends projecting beyond said links and interacting with sprocket wheels of said drive mechanism.

3. A trenching machine according to claim 1, wherein said carrying means comprises a plurality of carrying members mounted on an endless draft chain, and said support and guide means comprises a wheel mounted at a free end of said boom, a plurality of rollers arranged along said boom, and a thrust shoe mounted on the lower side of said boom between said wheel and said roller nearest thereto.

4. A trenching machine according to claim 1, wherein said spoil discharge conveyor assembly comprises a frame mounted on said vehicle, arms with at least one drive wheel and idler wheels thereon, mounted on said frame and interconnected by a linkage, said arms mounted on the lower side of said frame and at least one of the other arms being pivotally supported on said frame, an endless flight conveyor means going around said wheels, and a hydraulic cylinder operating said linkage, mounted on one of the side legs of said frame and connected with one of said arms pivotally supported on the lower side of said frame.

* * * * *